US006710678B2

(12) United States Patent
Thormar

(10) Patent No.: US 6,710,678 B2
(45) Date of Patent: Mar. 23, 2004

(54) WAVEGUIDE TYPE DUPLEX FILTER

(75) Inventor: Stefan Thormar, Fredensborg (DK)

(73) Assignee: Telefonaktiebolaget LM Ericsson(publ), Stockholm (SE)

( * ) Notice: Subject to any disclaimer, the term of this patent is extended or adjusted under 35 U.S.C. 154(b) by 0 days.

(21) Appl. No.: 10/181,792

(22) PCT Filed: Jan. 19, 2001

(86) PCT No.: PCT/DK01/00042

§ 371 (c)(1),
(2), (4) Date: Jul. 17, 2002

(87) PCT Pub. No.: WO01/54272

PCT Pub. Date: Jul. 26, 2001

(65) Prior Publication Data

US 2003/0001688 A1 Jan. 2, 2003

(30) Foreign Application Priority Data

Jan. 21, 2000 (DK) ..... 2000 00095

(51) Int. Cl.[7] ..... H01P 5/12; H01P 1/20
(52) U.S. Cl. ..... 333/135; 333/209
(58) Field of Search ..... 333/135, 101, 333/132, 134, 202, 207, 137, 208, 209

(56) References Cited

U.S. PATENT DOCUMENTS 4,777,654 A 10/1988 Conti ..... 455/81
4,800,349 A 1/1989 Gurcan et al. ..... 333/208
5,561,406 A 10/1996 Ikata et al. ..... 333/126
6,320,483 B1 * 11/2001 Raty et al. ..... 333/207
6,559,735 B1 * 5/2003 Hoang et al. ..... 333/134

FOREIGN PATENT DOCUMENTS

| | | | |
|---|---|---|---|
| EP | 0 274 859 | A1 | 7/1988 |
| EP | 0 817 303 | A2 | 1/1998 |
| EP | 0 917 235 | A2 | 5/1999 |
| EP | 0 959 519 | A1 | 11/1999 |
| EP | 0 964 471 | A1 | 12/1999 |

* cited by examiner

*Primary Examiner*—Patrick Wamsley
(74) *Attorney, Agent, or Firm*—Jenkens & Gilchrist, P.C.

(57) ABSTRACT

A waveguide type duplex filter having first and second waveguides which each comprise filtering means tuned to a given frequency, comprises two halves having a conducting surface. Faces directed toward each other are formed with channels which, when the halves have been assembled, constitute said waveguides. The filtering means are produced by means of a sheet having a conducting surface arranged between the two halves, and the conducting surface has openings which define and delimit resonators in the waveguides. The sheet can be arranged in first and second positions. In the first position, the resonators in the first waveguide are tuned to a first frequency, while the resonators in the second waveguide are tuned to a second frequency. In the second position, the resonators in the first waveguide are tuned to the second frequency, while the resonators in the second waveguide are tuned to the first frequency.

9 Claims, 2 Drawing Sheets

WAVEGUIDE TYPE DUPLEX FILTER

Figure 1:
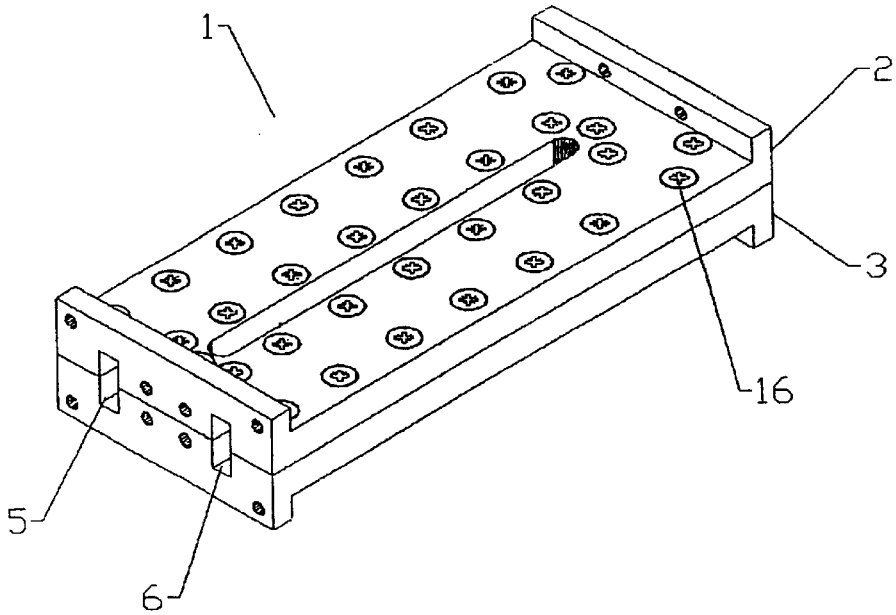

The invention relates to a waveguide type duplex filter having at least first and second waveguides which each comprise filtering means tuned to a given frequency, wherein the duplex filter has two mechanical halves with a conducting surface, wherein faces directed toward each other are formed with channels which, when the halves have been assembled, constitute said waveguides.

Duplex filters of the type to which the invention relates are used e.g. in connection with radio link terminals, where they ensure that a radio link terminal can transmit on one frequency and receive on another at the same time. Within a given frequency band, one of the two terminals, which constitute a radio link, transmits on a high frequency and receives on a low one. Similarly, the other terminal of the radio link receives on the high frequency and transmits on the low one in order for the two terminals to be able to communicate.

The corresponding duplex filters must reflect the same condition and must therefore be present as pairs, where one duplexer has a filter on the transmit side for a high frequency and a filter on the receive side for a low frequency. The other duplexer has a receive filter for the high frequency and a transmit filter for the low one. The receive filter prevents the strong signal from the transmitter from overloading the receiver, and the transmit filter must primarily restrict transfer of noise to the receiver and distortion products to the antenna.

A duplex filter may e.g. be realized with two separate filters which are connected to the antenna through a so-called circulator. The individual subfilters or filter branches can be manufactured in different ways. In case of high frequencies, which means frequencies higher than 7 GHz in practice, they may be formed in waveguide structures by means of different techniques. A filter may e.g. be a waveguide in which a plurality of resonators in the form of small sections of the waveguide are directly coupled to each other by means of coupling elements in the form of inductive irises, which are soldered on the walls of the waveguide at a mutual distance of e.g. half a wavelength.

A waveguide filter may also be constructed as a so-called E-plane filter, where a pattern, which defines the characteristic of the filter concerned, is produced in a metal sheet arranged between e.g. two metallic halves. The waveguide itself is formed by means of channels in the two halves. The metal sheet thus defines some partition walls in the waveguide which, in the same manner as inductive irises, constitute coupling elements between a plurality of resonators in the form of small sections of the waveguide. Such an E-plane filter is known e.g. from U.S. Pat. No. 4,800,349.

Another possibility of constructing a waveguide filter is to use dielectric resonators which are mounted in the waveguide.

The national authorities' allocation of frequency bands and specific frequencies for radio links normally means that the filters must be designed to cover just a portion of the allocated frequency band. In some of the above-mentioned filter types, the approach is that they can be trimmed with screws for a specific subband which contains the allocated frequency. The trimming is necessary partly to reduce the number of mechanical variants and partly to compensate for mechanical tolerances.

A duplex filter in waveguide technique may also be realized as an integrated unit consisting of a receive filter and a transmit filter which are coupled together via an adapted T-member to a common antenna port. The adaptation in the T-member ensures that the filters generate the desired frequency when they are coupled together.

Such an integrated duplex filter is known e.g. from EP 274 859. This document: describes a duplexer which consists of two mechanical halves of aluminium in which channels are formed. When the two halves are assembled, the channels, which are arranged opposite each other in the two halves, form waveguides which connect a receive port and a transmit port, respectively, with an antenna port. The filter effect is achieved here in that each of the two waveguides is provided with a plurality of stubs which constitute serial short-circuits at frequencies within the passage area of the filter, and which constitute finite reactances at other frequencies and thereby cause reflection. The number and dimensions of the stubs define the characteristic of the filter, such as centre frequency and bandwidth, and since the centre frequencies of the transmit filter and of the receive filter, respectively, are different, the stubs are thus also dimensioned differently in the two subfilters.

Although the trimming may be avoided by this duplexer, it is a serious drawback that since the stubs defining the characteristic of the individual filter are milled in the aluminium halves, these have to be manufactured individually for each frequency. The two duplex filters, which are to be used at their respective ends of a radio link, are different, too, since, as mentioned above, one must have a transmit filter with a high frequency and a receive filter with a low frequency, while the reverse applies to the filter at the opposite end. Thus, with this duplex filter type, a large number of different aluminium halves have to be manufactured in order to be able to build a system that utilizes the available channels within a given frequency band. Even the two duplex filters at their respective ends of a connection must consist of different parts, as mentioned.

Thus, an object of the invention is to provide a duplex filter of the type stated in the opening paragraph, where the necessary number of duplex filters for a system which utilizes the available channels within a given frequency band, may be manufactured by means of considerably fewer parts than in the prior art, and where at least the two duplex filters at their respective ends of a connection may be manufactured by means of identical parts.

This is achieved according to the invention in that said filtering means are produced by means of a sheet having a conductive surface which is arranged between the two halves, said conductive surface being provided with openings which define and delimit resonators in the two waveguides; that the sheet can at least be arranged in first and second positions; that, in the first position of the sheet, the resonators in the first waveguide are tuned to a first frequency, while the resonators in the second waveguide are tuned to a second frequency; and that, in the second position of the sheet, the resonators in the first waveguide are tuned to the second frequency, while the resonators in the second waveguide are tuned to the first frequency.

When such a sheet is used, the two duplex filters at their respective ends of a connection may be manufactured from just three parts, viz. the two mechanical halves and a sheet. The sheet is merely to be arranged in the first position in one filter and in the second position in the other filter. Moreover, the same two mechanical halves may be used for duplex filters for all pairs of frequencies in an entire frequency band, as only the sheets are frequency-specific. Thus, it is just necessary to stock the two halves as well as a plurality of sheets to be able to manufacture all the necessary duplex filters. And since the sheets just constitute a very small share of the total costs of a duplex filter, considerable savings can be achieved in this way.

It is expedient that, as stated in claim 2, the two mechanical halves consist of an electrically conductive material, since the halves may then be made exclusively of this material. As stated in claim 3, the said electrically conductive material may be aluminium in a particularly expedient embodiment, since this is inexpensive, easy to work and conducts well. In an alternative embodiment, as stated in claim 4, the electrically conductive material may be steel, which is likewise inexpensive, and which is moreover unique in having a low coefficient of temperature expansion.

As stated in claim 5, said sheet may expediently be a metal sheet, since this partly ensures a low sheet manufacturing price and partly means that said openings in the conducting surface may be produced by means of a range of various techniques, such as etching, laser cutting and the like. Alternatively, as stated in claim 6, said sheet may be a non-conducting sheet having an electrically conductive layer applied thereto. This means a more flexible sheet, and also provides the possibility that the openings may either extend through the entire sheet or just occur in the applied electrically conducting layer, as needed.

When, as stated in claim 7, said sheet has an area which corresponds to the area of the two halves where they are in contact with the sheet, a simpler assembly of the duplex filter is achieved, as the means holding the two mechanical halves together can simultaneously hold the sheet in place in its correct position relative to the halves. This obviates special control devices for ensuring the correct position of the sheet.

As stated in claim 8, the waveguides may expediently be provided with ports for the connection of external components, such as a receiver, a transmitter and an antenna, so that these may be connected directly to the duplex filter without further intermediate members. When additionally, as stated in claim 9, one or more of said waveguides have a bend so that the associated port is positioned solely in one of said halves, it is ensured that the flanges of the ports concerned are removed from the section that is present between the two halves. It is hereby considerably easier to make the flanges plane and tight, which is decisive for achieving sufficient isolation between transmitter and receiver.

Figure 2:
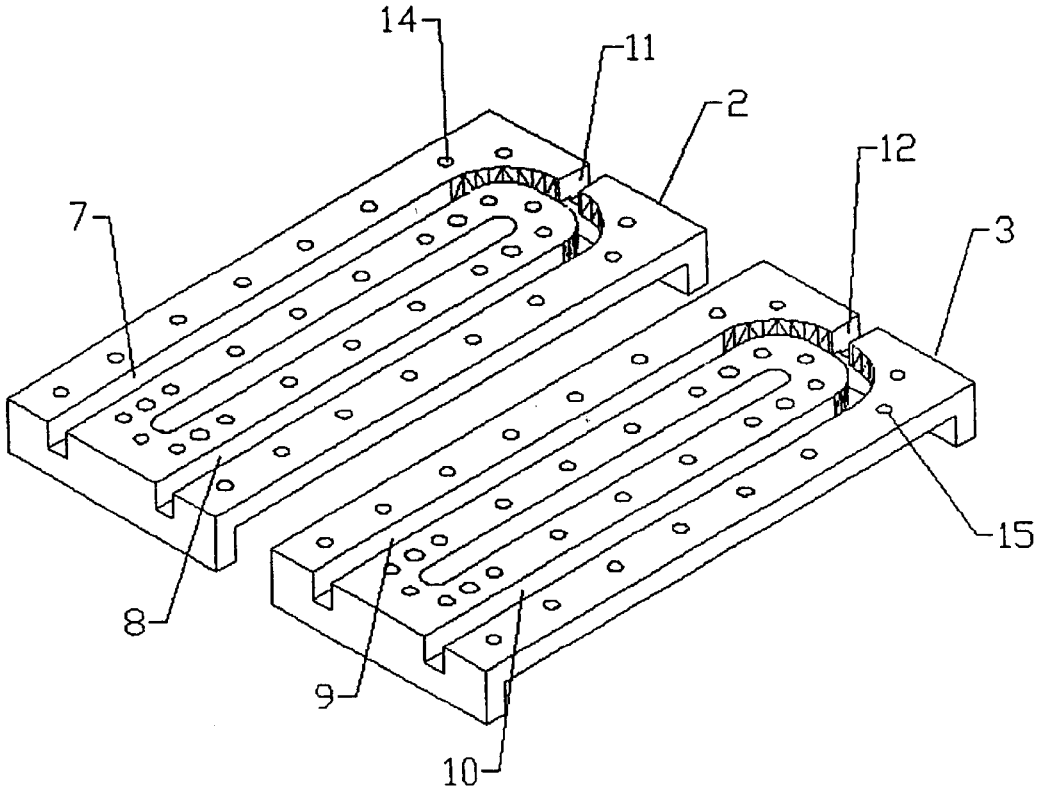
Figure 3:
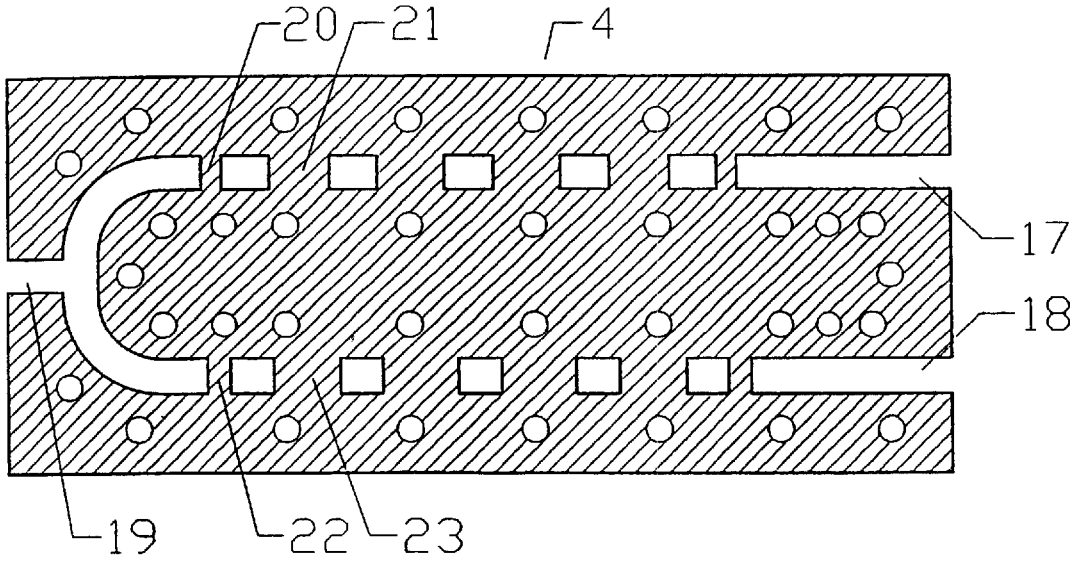
Figure 4:
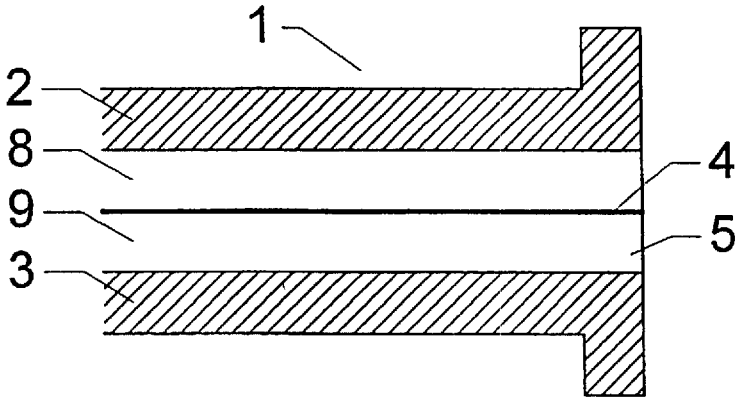
Figure 5:
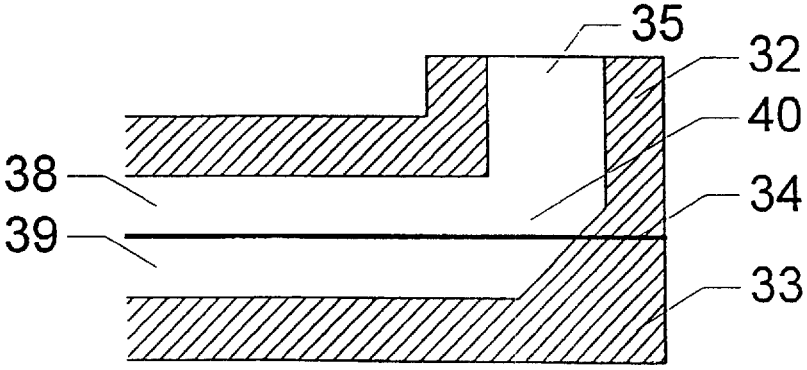

The invention will now be described more fully below with reference to the drawing, in which FIG. 1 shows a duplex filter according to the invention, FIG. 2 shows two halves for the duplex filter of FIG. 1, FIG. 3 shows a sheet for insertion between the two halves of FIG. 2, FIG. 4 shows a section through one end of the duplex filter of FIG. 1, and FIG. 5 shows a section through an alternative embodiment of a duplex filter according to the invention.

FIG. 1 shows an example of how a duplex filter 1 according to the invention may be constructed. The duplex filter 1 is composed of two parts or halves 2, 3, which are shown in FIG. 2, and which are clamped together around a sheet 4, which is shown in FIG. 3. Two waveguide flanges 5, 6 are shown on the, visible end face with a connection for a transmitter and a receiver, respectively. Concealed at the other end, a flange for an antenna is correspondingly provided.

The two halves 2, 3, which may be a top part 2 and a bottom part 3, are either entirely made of a material having a good electrical conductivity, e.g. aluminium, or they are just surface-treated with a well conducting material. It will be seen that the underside of the top part 2 is formed with a U-shaped groove of rectangular cross-section consisting of the two grooves 7, 8 which constitute their respective halves of a waveguide, there being quite corresponding grooves 9, 10 in the top side of the bottom part 3. A groove 11 of the same cross-section leads from the centre between the grooves 7 and 8 out to the other end of the top part 2, and a corresponding groove 12 is present in the bottom part 3. The end of this groove constitutes the antenna connection. The grooves 7, 8 and 9, 10, respectively, are formed mirror-symmetrically about an axis through the common branch 11 and 12, respectively. The dimensions of the grooves are adapted such that the waveguides which are provided when the parts have been assembled, have the correct dimensions for the frequency band for which the duplex filter is to be used. For example, the waveguide groove in a duplex filter for one of the two extensively used frequency bands around 18 or 23 GHz is about 5 mm deep and 4 mm wide in each half, which corresponds to a standard waveguide with the designation R220.

Further, both halves are provided with a plurality of holes, e.g. the holes 14 and 15 which serve to assemble the halves by means of screws, as is shown e.g. at the screw 16 in FIG. 1.

The sheet 4, which is shown in FIG. 3, has the same external dimensions as the cut face between the two halves 1, 2; but since it is fixed between them, it is not visible in FIG. 1. The sheet 4 is formed with grooves 17, 18 and 19, which correspond to the grooves in the two halves 2, 3. In FIG. 3, the antenna port is positioned to the left and the two ports for the transmitter and the receiver, respectively, to the right. Like the halves, 2, 3, the sheet 4 may either be made entirely of a material having a good electrical conductivity, e.g. a metal sheet, or it may merely be surface-treated with a well conducting material.

As will be seen from the figure, the grooves 17 and 18 are interrupted by a number of transverse connections, e.g. the transverse connections 20, 21, 22 and 23. When the duplex filter is assembled, these transverse connections appear as longitudinal partition walls in the waveguides concerned, and they thereby define and delimit a number of resonators which give the desired filter effect. The width of the individual transverse connections and the distance between them define the passage frequency range of the filter concerned in a generally well-known manner. As will appear, the transverse connections in the two grooves 17 and 18 are different, as the two filters must be tuned precisely to two different frequencies. The pattern in the sheet material may be produced by e.g. etching, laser cutting or punching.

This type of filter is called E-plane filter, because the mentioned transverse connections are inserted centrally in the E-plane of the TE01 field centrally in the waveguide. The spaces between the longitudinal walls constitute resonators in the waveguide, and the walls define the coupling between the resonators. By adjusting the dimensions of walls as well as spaces the desired filter characteristic may be achieved.

Apart from the transverse connections, the grooves in the sheet, like the grooves in the two halves, are shaped mirror-symmetrically about an axis through the common branch 19. This means that the sheet 4 may be positioned in two ways between the two halves 2 and 3. In one position, the groove 17 is present in the waveguide formed by the grooves 7 and 10, while the groove 18 is correspondingly present in the waveguide which is formed by the grooves 8 and 9. If the sheet is turned to the second position, the grooves 17 and 18 change places. This means that the filter defined by the sheet in one branch of the duplexer is moved to the opposite branch when the sheet is turned.

By just turning one and the same sheet it is hereby possible differently to manufacture the two filters, which are to be used at their respective ends of a radio link, from the same components, as a specific pair of frequencies is used for transmission in different directions in a given connection. The same halves may be used for the other pairs of frequencies in a given frequency band. Just a sheet variant is required for each pair of frequencies. Typically, the manufacturing costs of the metal sheet constitute less than 5% of the total costs of a duplex filter of the type described, and it is therefore an extremely cost-effective solution that it is just the sheets which are to be stocked in a number of variants.

FIG. 4 shows a section through one end of the duplex filter 1 from FIG. 1. As can be seen, the waveguide flange 5, i.e. the flange where the waveguide formed by the grooves 8 and 9 terminates at one end face of the duplex filter, is present precisely in the section where the two halves 2 and 3 are assembled around the sheet 4. This makes it relatively difficult to achieve a plane and tight sheet, which is decisive for achieving sufficient isolation between transmitter and receiver.

An additionally optimized embodiment is therefore shown in FIG. 5, which includes a 90 H-bend on the connection to the port so that the associated flange is positioned on the top side of the structure. Again, the duplex filter consists of two halves 32 and 33 and a sheet 34. A bend 40 is now provided on the waveguide formed by the grooves 38 and 39, so that the waveguide terminates at a flange 35 on the top side of the top part 32. Corresponding bends may be provided in the other waveguides of course. It is hereby ensured that the flanges are removed from the section centrally in the structure, and the flanges are thereby plane and tight both mechanically and electrically.

As mentioned, the two halves 2 and 3 may e.g. be made of aluminium. An alternative to aluminium is steel. This material, like aluminium, is a relatively inexpensive material, and moreover it has a considerably lower coefficient of temperature expansion than aluminium, which is of importance as the characteristics of the filter change with the expansion of the material. On the other hand, the conductivity of steel is not as good as that of aluminium; but this may be compensated by applying to the steel workpiece a surface layer of e.g. silver which has a better conductivity.

Although a preferred embodiment of the present invention has been described and shown, the invention is not restricted to it, but may also be embodied in other ways within the subject-matter defined in the following claims.

What is claimed is:

1. A waveguide type duplex filter having at least first and second waveguides which each comprise filtering means tuned to a given frequency, wherein the duplex filter comprises two mechanical halves with a conducting surface, wherein faces directed toward each other are formed with channels which, when the halves have been assembled, constitute said waveguides, wherein said filtering means are produced by means of a sheet having a conducting surface which is arranged between the two halves, said conducting surface being provided with openings which define and delimit resonators in the two waveguides, said sheet can at least be arranged in first and second positions, that, in the first position of the sheet, the resonators in the first waveguide are tuned to a first frequency, while the resonators in the second waveguide are tuned to a second frequency, and that, in the second position of the sheet, the resonators in the first waveguide are tuned to the second frequency, while the resonators in the second waveguide are tuned to the first frequency.

2. The duplex filter according to claim 1, wherein said two mechanical halves consist of an electrically conducting material.

3. The duplex filter according to claim 2, wherein said electrically conducting material is aluminium.

4. The duplex filter according to claim 2, wherein said electrically conducting material is steel.

5. The duplex filter according to claim 1, wherein said waveguides are provided with ports for the connection of external components, such as a receiver, a transmitter and an antenna.

6. The duplex filter according to claim 5, one or more of said waveguides have a bend so that the associated port is positioned solely in one of said halves.

7. The duplex filter according to claim 1, wherein said sheet is a metal sheet.

8. The duplex filter according to claim 1, wherein said sheet is a non-conducting sheet having an electrically conducting layer applied thereto.

9. The duplex filter according to claim 1, wherein said sheet has an area which corresponds to the area of the two halves where they are in contact with the sheet.

* * * * *